US005584095A

United States Patent [19]

Redding et al.

[11] Patent Number: 5,584,095

[45] Date of Patent: Dec. 17, 1996

[54] VACUUM CLEANER HAVING IMPROVED STEERING FEATURES

[75] Inventors: Glenn K. Redding, Gulfport, Miss.; Kristen G. Sprow-Byrd, Royal Oak, Mich.; Michael D. Collins; James R. Hunter, Jr., both of Pass Christian, Miss.; Gary A. Miller, Gulfport, Miss.; Christopher A. Robinette, Redwood City, Calif.; Walter L. Webb, Long Beach, Miss.; Barry W. Chaffin, Biloix, Miss.; Charles W. Reynolds, Long Beach, Miss.

[73] Assignee: Philips Electronics North America Corporation, Tarrytown, N.Y.

[21] Appl. No.: 266,762

[22] Filed: Jun. 28, 1994

Related U.S. Application Data

[63] Continuation-in-part of Ser. No. 89,978, Jul. 9, 1993, Pat. No. 5,323,510.

[51] Int. Cl.[6] ..... A47L 9/32

[52] U.S. Cl. ..... 15/411; 15/323; 15/339; 280/47.11

[58] Field of Search ..... 15/339, 340.2, 15/410, 411; 280/47.11

[56] References Cited

U.S. PATENT DOCUMENTS

| | | | |
|---|---|---|---|
| 882,574 | 3/1908 | Moukos | 15/411 |
| 1,139,736 | 5/1915 | Stabel | 15/411 |
| 1,161,908 | 11/1915 | Tice | 15/411 |
| 2,162,313 | 6/1939 | McCabe | 15/411 X |
| 2,974,347 | 3/1961 | Seyfried | 15/411 X |
| 3,354,496 | 11/1967 | Jonsson | 15/410 X |
| 5,075,921 | 12/1991 | Gleadall | 15/410 X |

*Primary Examiner*—Chris K. Moore
*Attorney, Agent, or Firm*—Jones & Askew

[57] ABSTRACT

An upright steerable vacuum cleaner is provided, which includes the use of a pivotable cylindrical motor housing, as well as a universal joint which is attached to the motor housing, such that twisting at the upper body of the vacuum cleaner clockwise causes the base of the unit to turn right, and twisting in the opposite direction causes it to turn left.

13 Claims, 19 Drawing Sheets

VACUUM CLEANER HAVING IMPROVED STEERING FEATURES

TECHNICAL FIELD

This application is a continuation-in-part of application Ser. No. 089,978, filed Jul. 9, 1993 now U.S. Pat. No. 5,323,510, issued Jun. 28, 1994. This invention relates in general to vacuum cleaners, and particularly relates to vacuum cleaners which have an improved "steering" feature, including those having locking features to lock out the steering feature if desired.

BACKGROUND OF THE INVENTION

In the field of vacuum cleaners, a need has been recognized to provide vacuum cleaners which have improved maneuverability features. The prior art is replete with powered upright vacuum cleaners and vacuum cleaners which include L-shaped nozzles which allow the operator to vacuum around objects such as chair legs.

However, a need still exists for an upright vacuum cleaner which has improved maneuverability features not provided by the prior art.

SUMMARY OF THE INVENTION

The present invention provides an improved upright vacuum cleaner which has improved maneuverability features, and which is cost-effective to produce, operate, and maintain.

It is an object of the present invention to provide an improved vacuum cleaner.

It is an object of the present invention to provide a vacuum cleaner which has improved cleaning features.

It is an object of the present invention to provide a vacuum cleaner which has improved maneuverability features.

It is an object of the present invention to provide a vacuum cleaner which is easy to operate.

It is an object of the present invention to provide a vacuum cleaner which is cost-effective to produce.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

Figure 1:
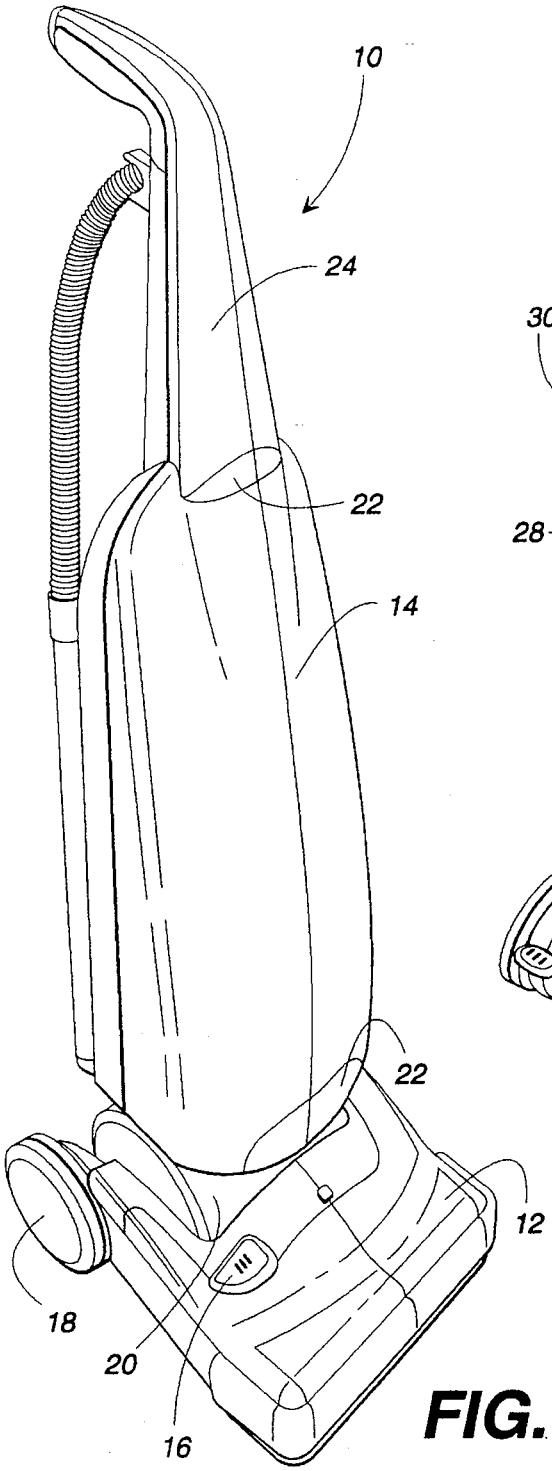
FIG. 1 is a front, right, pictorial view of a first embodiment of an upright vacuum cleaner according to the present invention.

Referring now to the Figures, in which like numerals indicate like parts throughout the several views, FIG. 1 illustrates an upright vacuum cleaner 10 including a lower base 12 and an upright body 14. The base 12 includes a height adjustment switch 16, and a pair of rear wheels 18. The base 12 also includes a cylindrically-shaped motor housing 20. The upright body 14 may include a light 22, and an upright handle portion 24.

Figure 2:
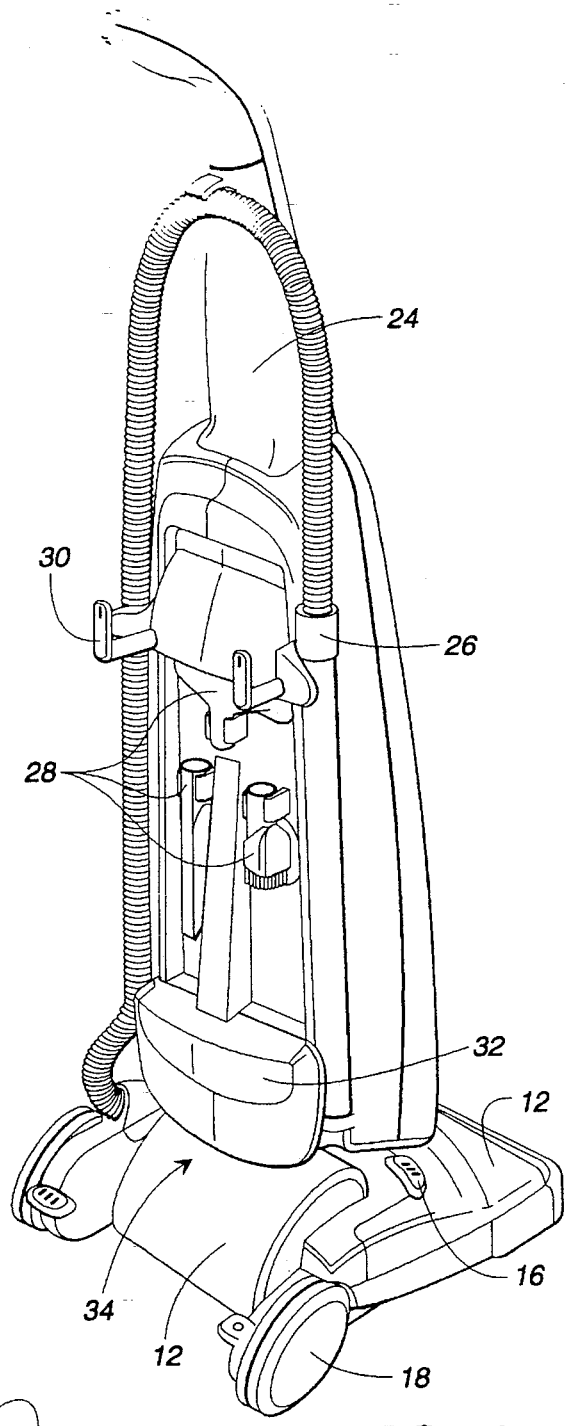
FIG. 2 is a rear, right view of the upright vacuum cleaner illustrated in FIG. 1.

Referring now also to FIG. 2, hose assembly 26, tools 28, cord wrap flanges 30, 32, and upper and lower universal joint subassembly 34 are shown.

Figure 3:
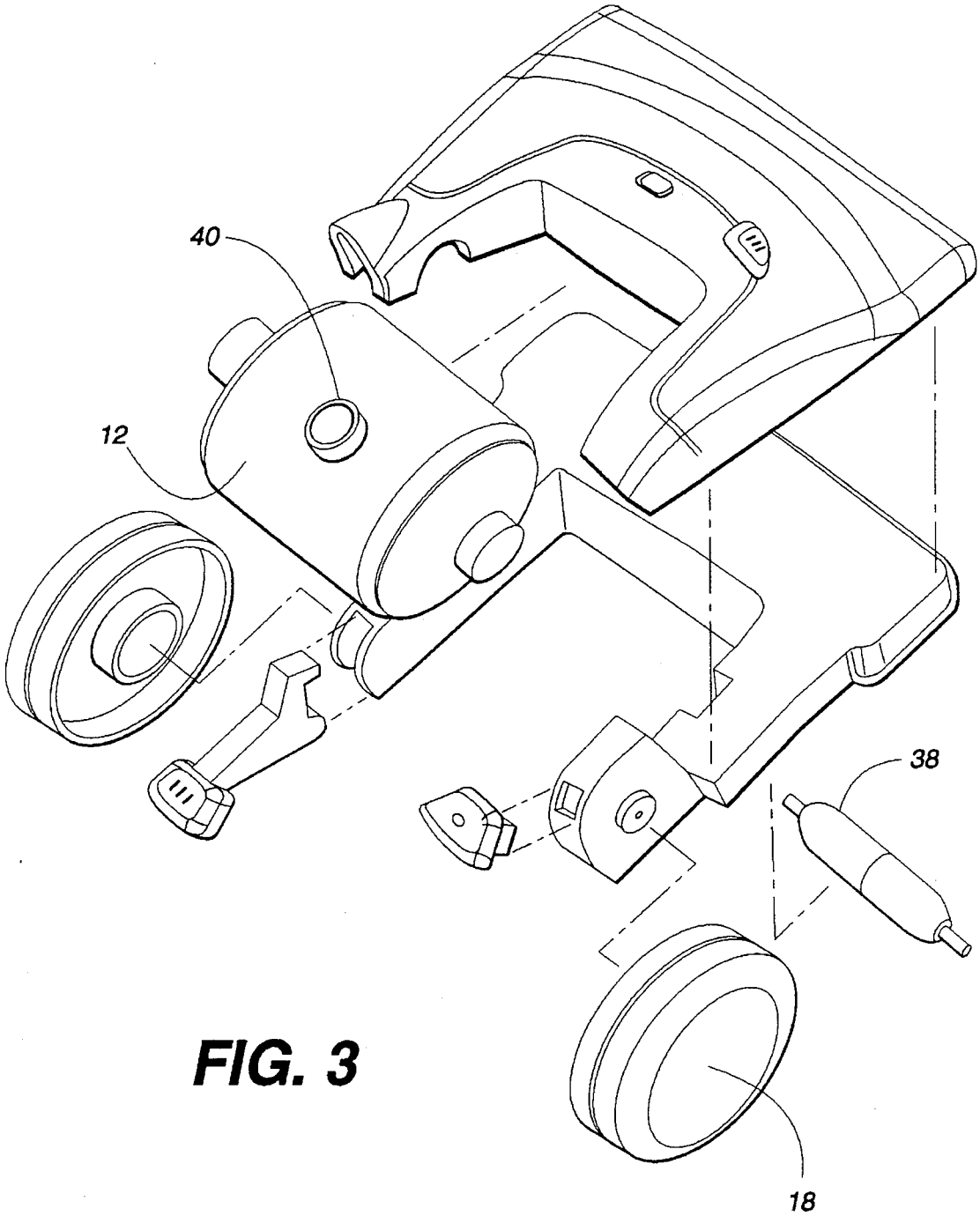
FIG. 3 is an exploded view illustrating some elements of the base of the vacuum cleaner shown in FIG. 1.

Referring now to FIG. 3, some of the previously discussed elements are illustrated, along with a front roller 38.

Figure 4:
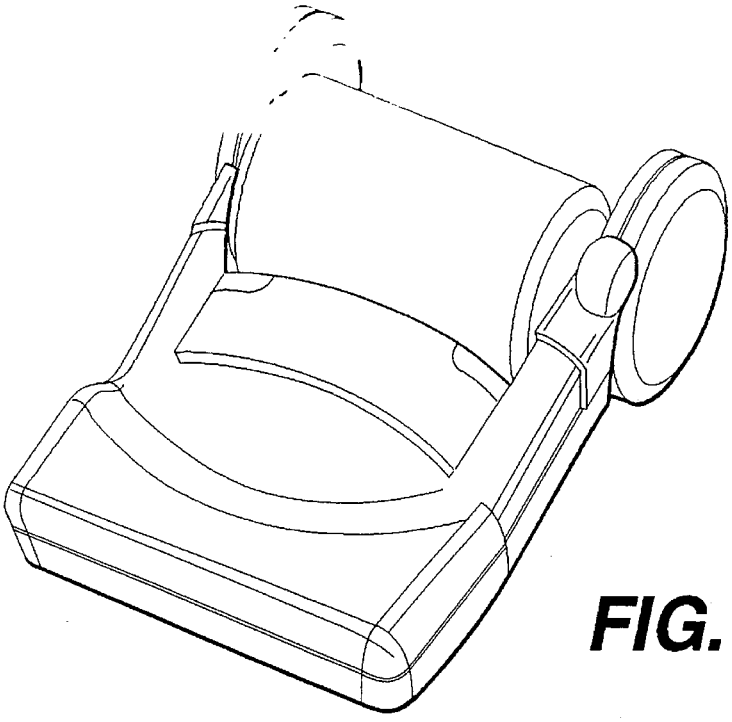
FIGS. 4 and 5 are additional embodiments of a base of the vacuum cleaner according to the present invention, including an alternate preferred universal joint assembly.
Figure 5:
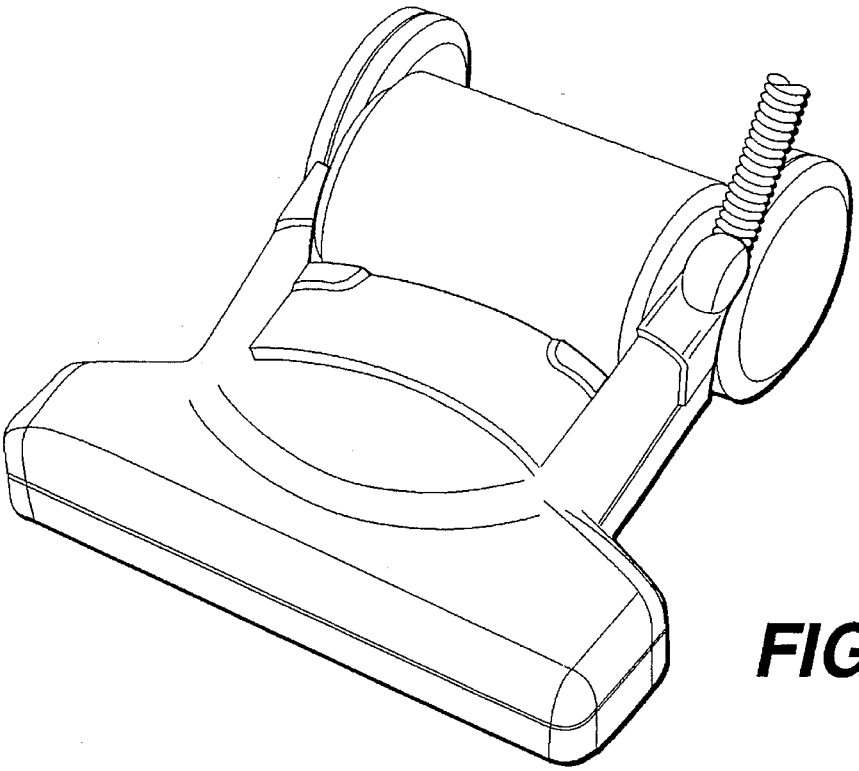

Referring now to FIGS. 4 and 5, various base configurations are shown.

Referring now to FIGS. 6–9, a side view of one embodiment of the universal joint assembly 34 is illustrated. Operation of this assembly 34 is now discussed. As may be understood, an upper universal joint member 44 is rotatably mounted relative to lower universal joint member 40 along a pivoting axis P. These members are joined by an intermediate collar 42 such that air can be transferred from member 40 to member 44. The upper universal joint member 44 is rigidly attached relative to body member 14 and facilitates the transfer of air into the body through an internal air channel. Lower universal joint member 42 is likewise rigidly affixed relative to cylindrically-shaped motor housing 20 and receives air from a motor within the housing 20. The motor housing 20 is pivotably mounted relative to the base 12 of the vacuum cleaner, along substantially horizontal axis X. Intermediate collar 42, in the embodiment shown is composed of two halves joined together by fasteners such as is known in the art.

As may be understood, the lower universal joint member 40 has an annular tapered "male" portion 50 (see FIG. 8) which fits within an annular tapered "female" portion 52 (see FIG. 9) of the upper universal joint member 44. The intermediate collar 42 locks these two elements 40, 44, together such that they may rotate relative to each other along axis P (see FIG. 6) described above, and at the same time air may be transferred from member 40 to member 44.

The intermediate linking collar 42, when in place, is rotatably mounted to the lower universal joint member by means of outwardly-directed annular ribs 54 (see FIG. 8) of the lower universal member mating with a single inwardly-directed annular ring (not shown) inside the collar 42, allowing the collar to rotate along axis P relative to the lower universal joint member 40, but limiting movement of the two members along axis P. By a similar interlocking relationship provided by outwardly-directed annular ribs 56 of the upper universal member mating with mating with a single inwardly-directed rib (not shown) in the collar, the collar 42 is rotatably mounted relative to the upper universal joint member 44, with the two elements allowed to rotate relative to each other along axis L.

Figure 10:
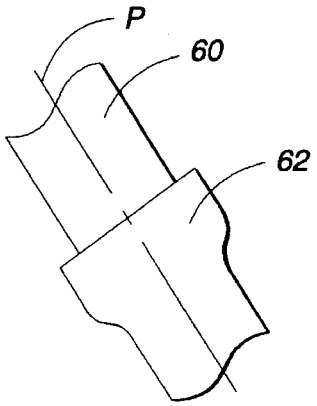
FIG. 10 is an illustrative view of an alternate universal joint member not including the use of an intermediate collar.
Figure 8:
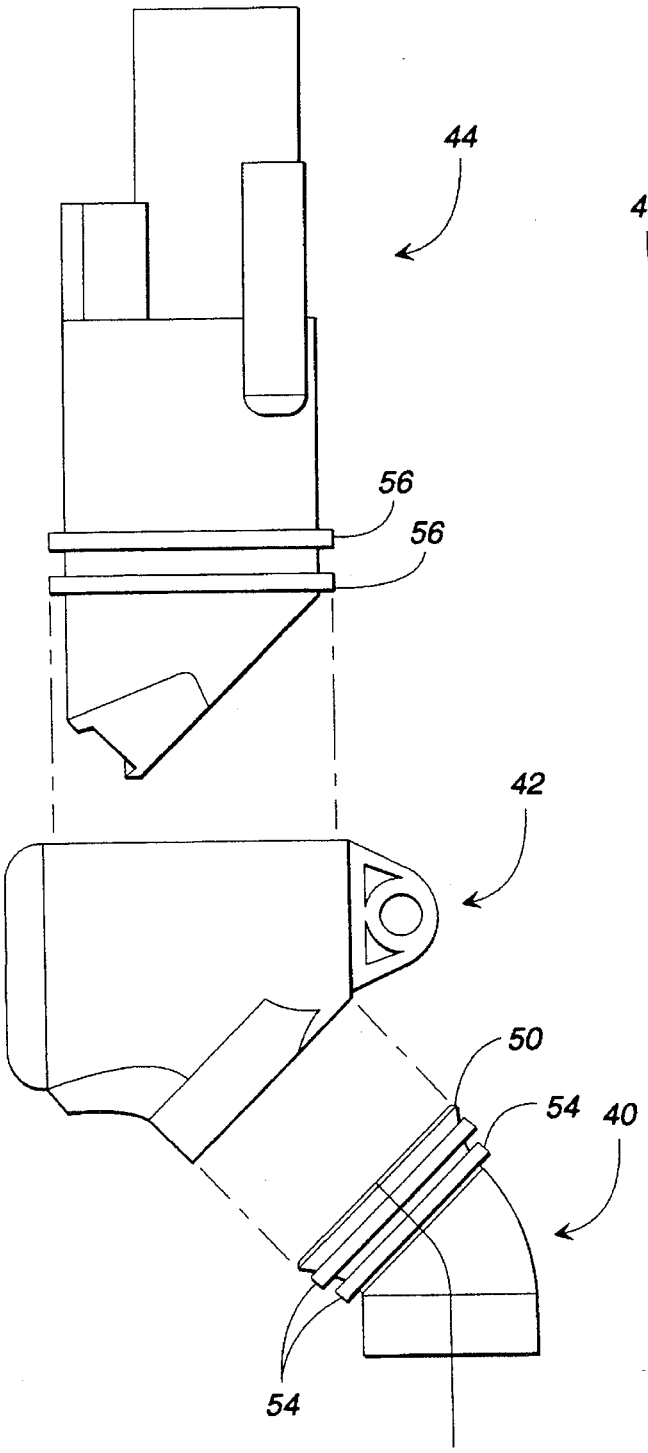
FIG. 8 is right side exploded view of that shown in FIG. 7.
Figure 9:
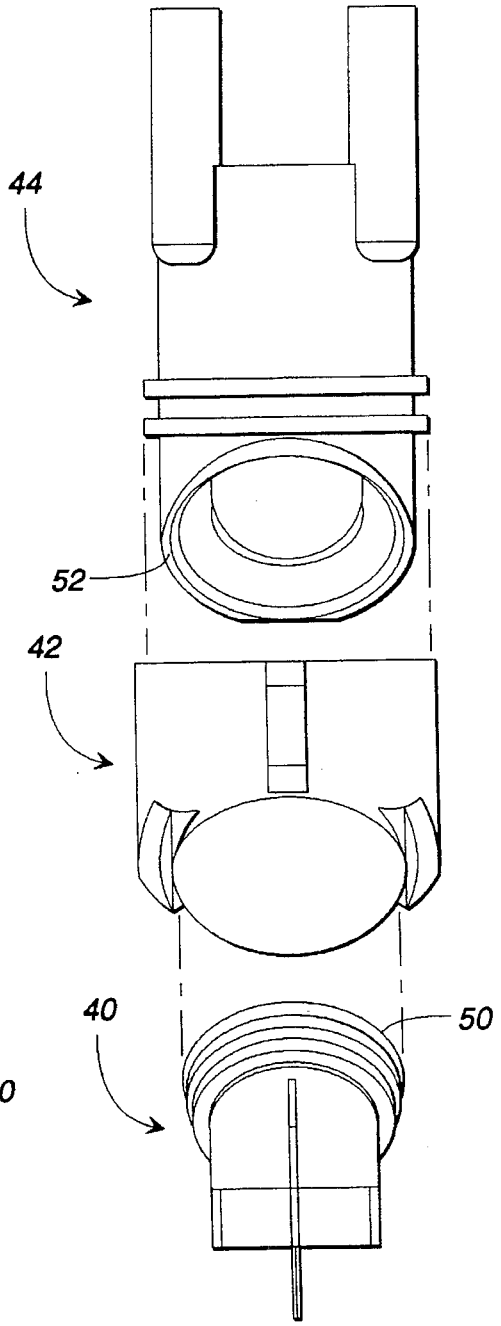
FIG. 9 is a front exploded view of that shown in FIG. 7.
Figure 11:
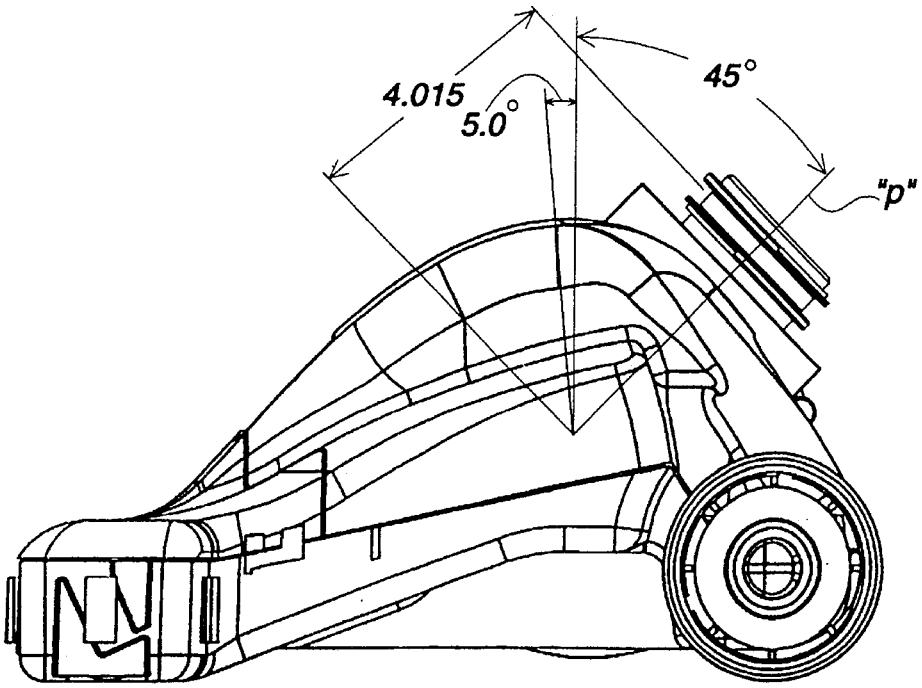
FIG. 11 is a side view of the base of the unit, illustrating various angular orientations and distances.

Other universal joint configurations are also contemplated under the present invention. For example, as shown in FIG. 10 an alternate universal joint configuration is contemplated in which, for example, a lower universal member 62 (which is assembled from two halves and attached by fasteners as known in the art) interlocks with an upper universal joint member 60 without the use of a collar. The upper and lower members would be rotatably interlocked by the use of interlocking annular ribs on the two members providing interlocking of the members as described above. The lower universal joint member, being a "female" member 62, accepts and surrounds the lower end of the upper universal joint member, being a "male" member, providing for rotational or relative pivoting movement of the two members about an axis such as "P", described above, with travel along the axis being limited by the interference of the annular ribs. Member 62 is attached to the pivoting motor housing and member 60 is attached to the upper body in a manner similar to that described above.

Figure 6:
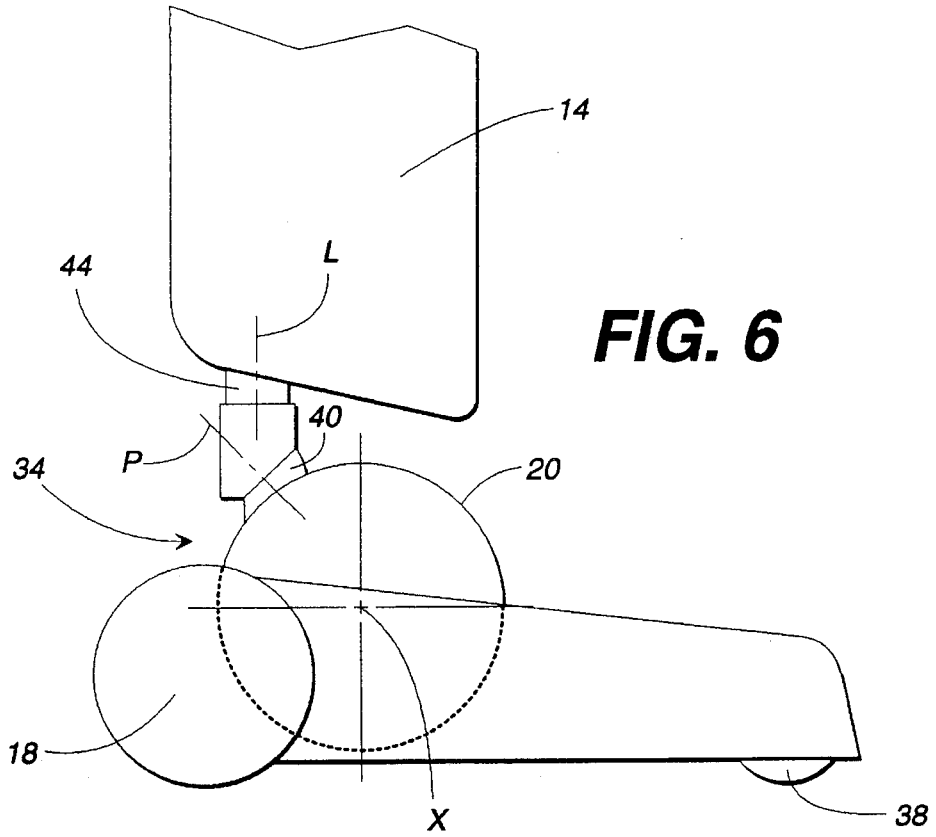
FIG. 6 is a side illustrative view of that shown in FIG. 4.
Figure 7:
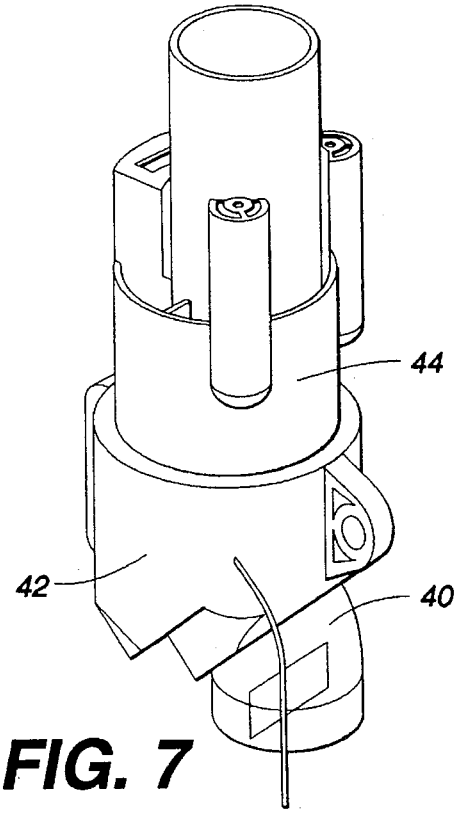
FIG. 7 is an upper right pictorial view of the universal joint being part of the present invention.

As may be understood, when the operator operates the upright vacuum cleaner, the operator first pivots the upright body 14 from its relatively vertical position illustrated in FIG. 6 to a more inclined position. As the vacuum cleaner is operated, if the operator is pushing the vacuum cleaner generally forward, the operator may "twist" the handle to cause the handle and body to turn in a clockwise or counterclockwise direction substantially along their longitudinal axes. In the instance of the configuration illustrated in FIG. 6, if the operator twists the body 14 in a clockwise direction along its longitudinal axis, the base 12 will tend to turn to the right as it is being pushed forwardly. Likewise, if the body 14 is rotated in a counter-clockwise direction along their longitudinal axis, the base 12 will tend to turn leftwardly as it is being pushed in a forward direction. As may be understood, such a configuration is an improvement over the prior art in that by a continuation of pushing and twisting the handle of the vacuum cleaner, the base may be simply and easily maneuvered in a novel manner.

The air flow throughout the unit is as follows. A motor within the motor housing 20 is energized, such that air is drawn from beneath the base 12, into the motor housing through a suitable connection, into the lower universal member, into the upper universal member, and into the body and into a filtration bag or canister.

Reference is now made to FIGS. 11–24, which illustrate a "five-piece" embodiment according to the present invention.

Basics

Generally speaking, the embodiment shown in FIGS. 11–24 includes a universal joint which includes the use of a two-part motor housing having a "male" joint element extending therefrom, which is accepted by a two-piece "female" joint element which during assembly captures the male portion to allow relative rotational movement of the male and female elements along a motor housing pivot axis "X". In this embodiment, as before, the motor housing is itself allowed to rotate along a substantially horizontal axis relative to a base of the unit.

It may be understood that the terms "pivotal" and "rotational", with respect to relative movement of two elements, may be used in similar manner, as it may be understood that one element may pivot or rotate relative to each other along an axis. For example, it may be said that the motor housing rotates or pivots relative to the base of the unit. However, when the word "rotate" is used, it does not necessarily mean that complete 360 degree rotation is possible. In practice, the motor housing "rotates" relative to the base less than 360 degrees.

Universal Joint Construction Generally

Figure 12:
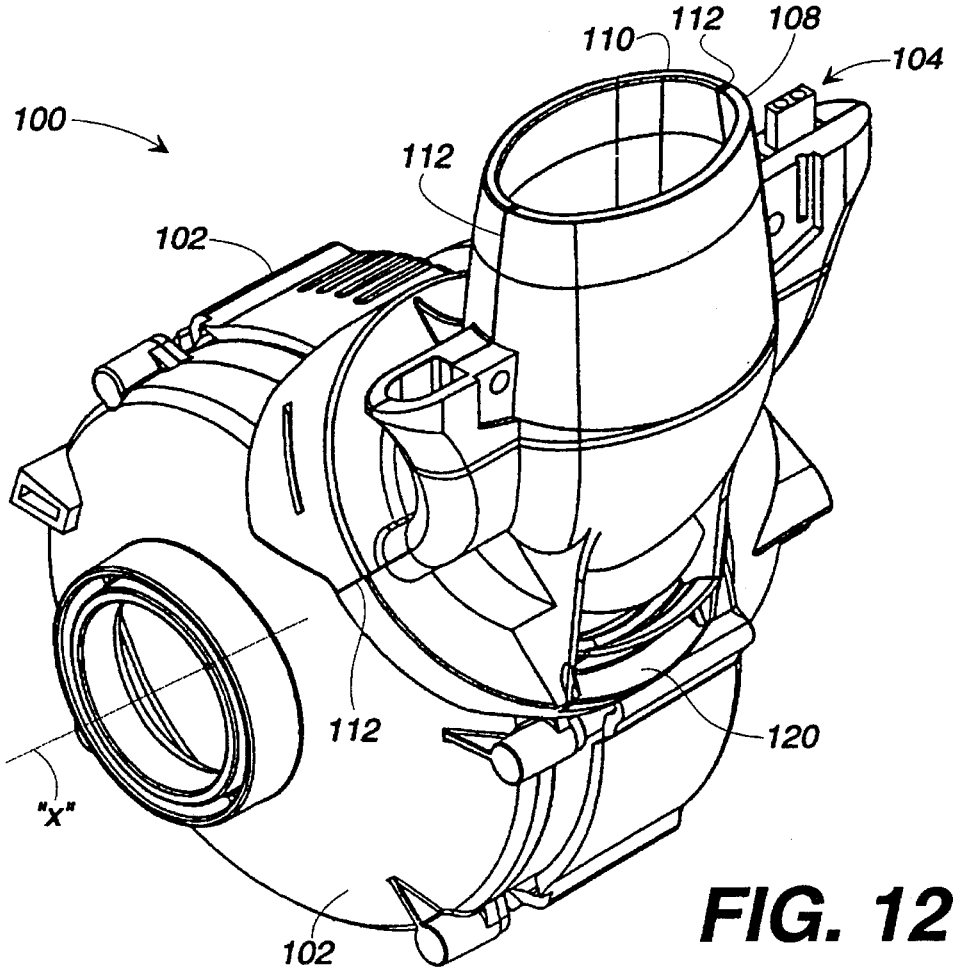
FIG. 12 is an isolated perspective view of a motor housing/universal joint assembly, as if viewed from the left rear of the unit a slight elevation.
Figure 13:
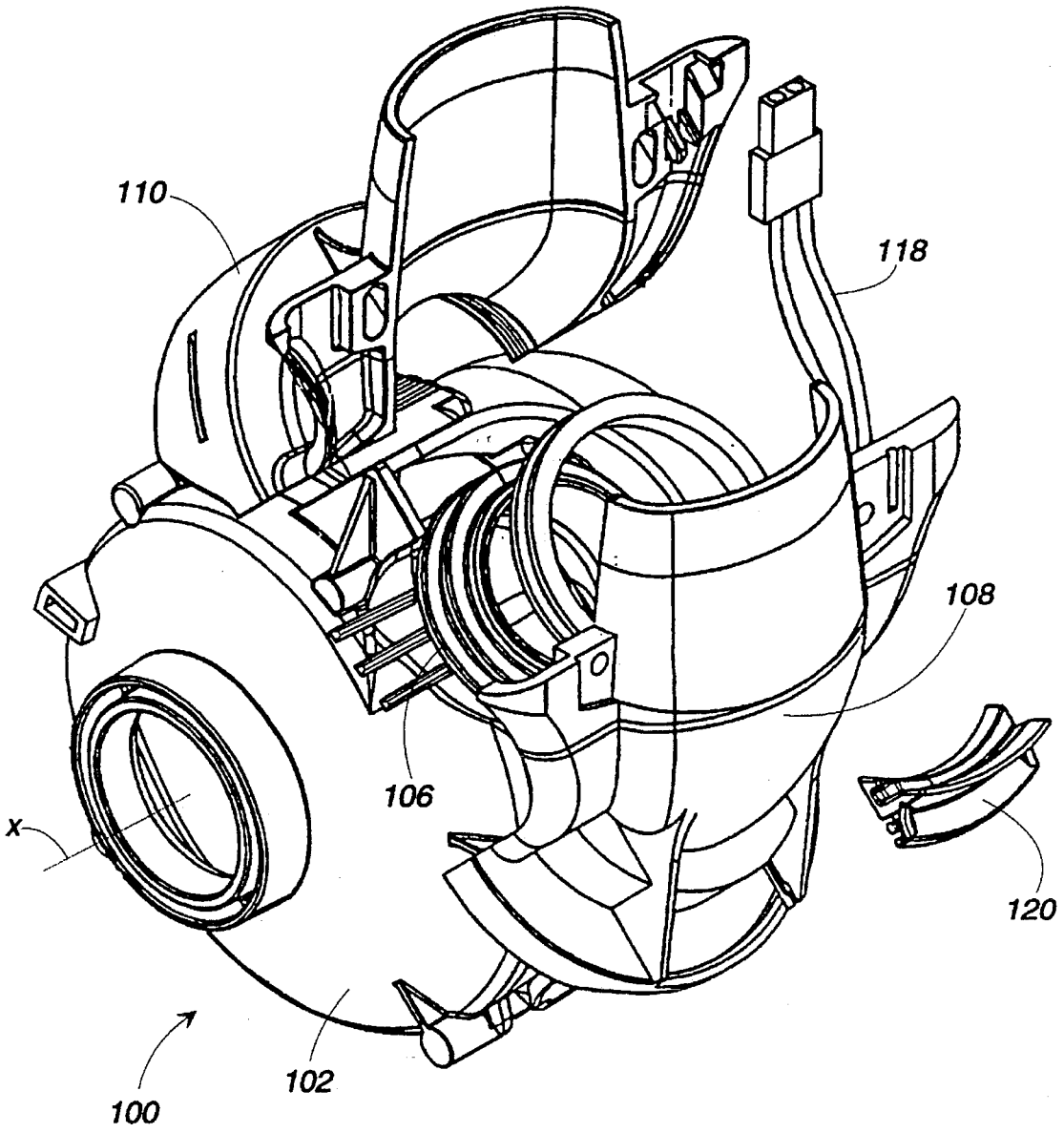
FIG. 13 is a view similar to that of FIG. 12, with various elements shown in exploded view.

Referring particularly to FIGS. 12 and 13, a motor housing/universal joint subassembly 100 is illustrated. This subassembly 100 includes two main elements, a motor housing 102 (having a lower universal joint member or "portion" extending therefrom), and an upper universal joint member or "portion" 104. The motor housing is configured to pivot or rotate about a substantially horizontal axis "X" (See FIG. 13), relative to a base element 154 of the unit (see FIG. 18). Referring again to FIGS. 12 and 13, a lower, male universal member 106 is part of and extends from the motor housing 102, and is captured by the upper universal joint member 104 while still allowing pivotal or rotational movement therebetween along a second axis "P" (See FIG. 16).

Figure 14:
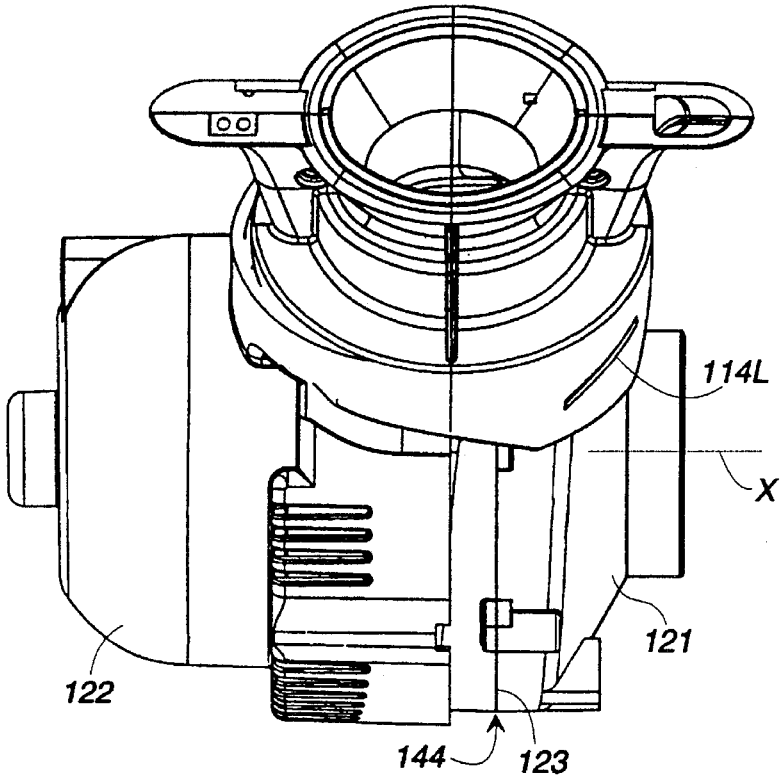
FIG. 14 is a top plan view of that shown in FIG. 12, with the front of the unit being situated at the bottom of the page.
Figure 15:
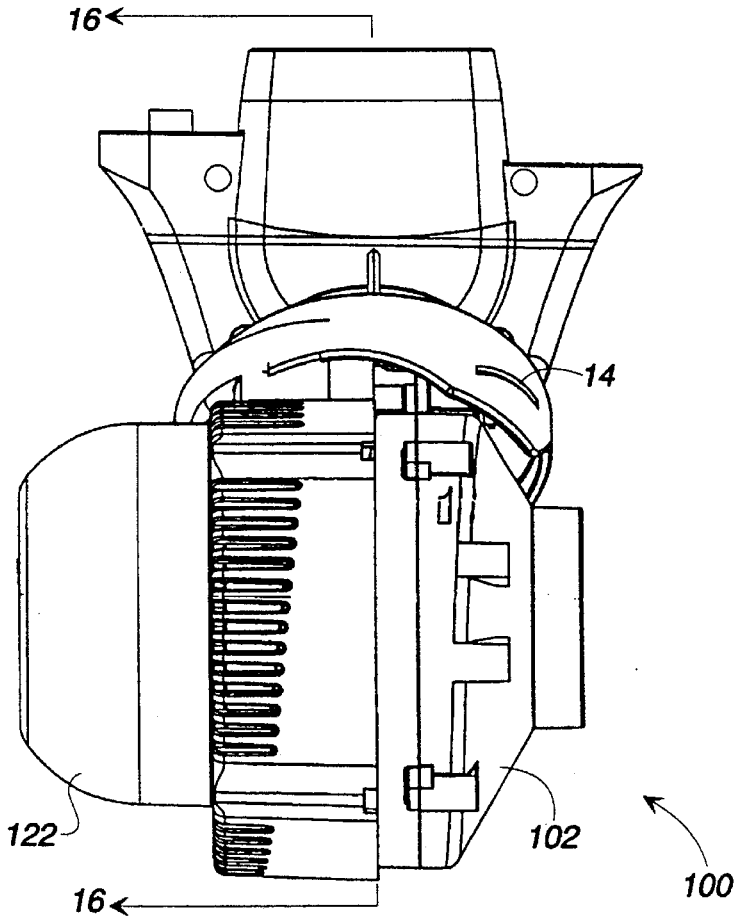
FIG. 15 is a front plan view of the unit illustrated in FIG. 11.

Referring now to FIG. 14, The motor housing 102 includes three main elements, a shroud 121, a motor cover 122 and a bulkhead 144. These members are rigidly attached together as shown in FIG. 14 to meet at a join line 123, which is actually occupied by a thin flange 144 which extends from the bulkhead 144 discussed later. With the aid of five mounting screws at 127 (See FIG. 16) the shroud, motor cover, and bulkhead are affixed together. The fan shroud 121 and bulkhead 144 combine to at least partially form the air path for air driven by a fan (not shown) driven by the motor.

A motor (not shown) is mounted to the bulkhead, such that the motor is rigidly mounted relative to the motor housing.

The lower "male" universal joint member 106 extends from the motor housing and defines a pair of outwardly-extending annular rings. These rings are captured by inwardly-directed annular rings of the upper universal member, and provide guidance to allow the upper universal joint member to rotate relative to the lower universal joint member (within prescribed limits), such that the upper universal joint member rotates relative to the lower universal joint member along a rotational or pivotal axis "P" substantially in the center of the annular rings.

It should be understood that the lower, male, universal joint member 104 is composed of a part of the bulkhead 144 (See FIG. 16) and a part of the fan shroud.

Figure 16:
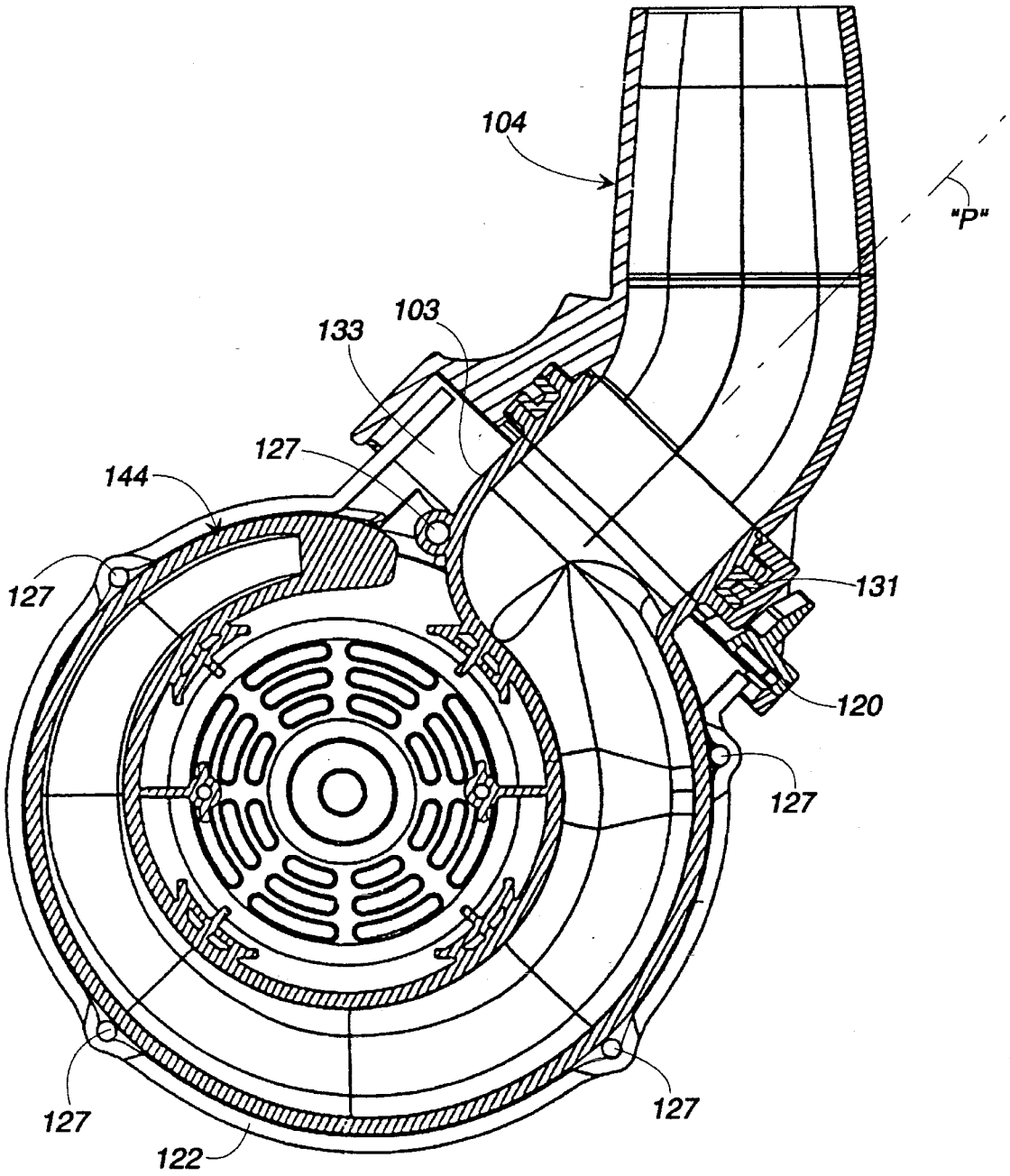
FIG. 16 is a side cutaway view of that shown in FIG. 14, cut along line A—A.
Figure 17:
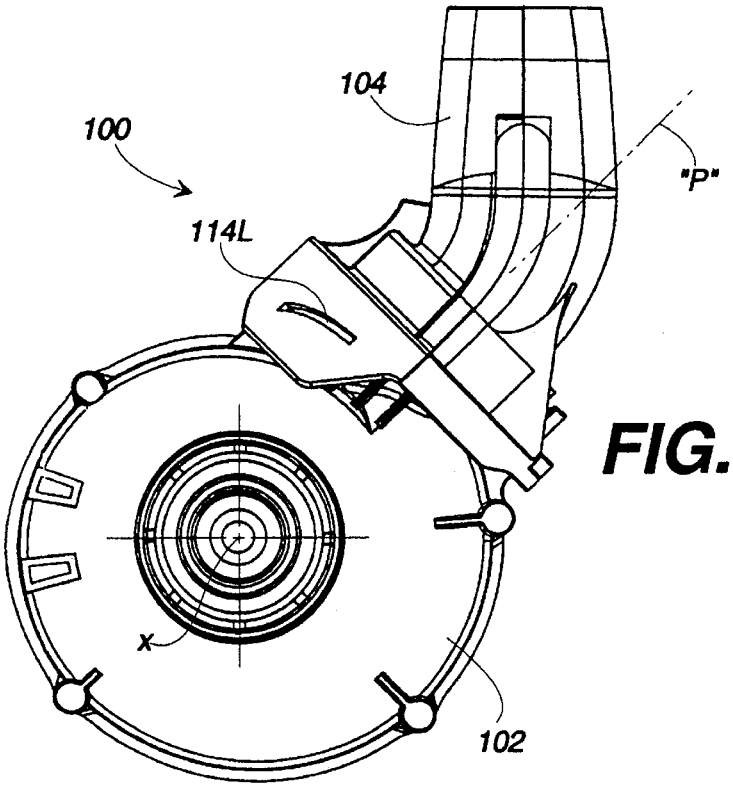
FIG. 17 is a right side plan view of that shown in FIG. 14.

As discussed above, the upper universal joint member 104 (See FIGS. 12 and 13) includes two main parts, a front part 110 and a rear part 108. The parts 11 () and 108 mate together along a join line 112, to form a female member which accepts the male member discussed above. The upper universal joint member 104 is allowed to pivot relative to the lower male member 104 along on axis "P". Referring now to FIG. 16, an interlocking design is illustrated which includes interlocking ribs and channels defined by the male and female members, with a seal member (having a U-shaped radial cross section) intermediate the male and female members to provide bearing support and air sealing.

Joint Operation

As discussed with respect to the configuration shown in FIGS. 11–24, the apparatus 150 (see FIG. 24). allows an operator to "steer" the device by manipulating the universal joint. When the operator operates the upright vacuum cleaner, the operator first pivots the upright body from its relatively vertical position to a more inclined position. As the vacuum cleaner is operated, if the operator is pushing the vacuum cleaner generally forward, the operator may "twist" the handle to cause the handle and body to turn in a clockwise or counterclockwise direction (as viewed by the operator) substantially along its longitudinal axes. In the instance of the configuration illustrated in FIG. 24, if the operator twists the body 152 in a clockwise direction along its longitudinal axis, the base 154 will tend to turn to the right as it is being pushed forwardly. Likewise, if the body 152 is rotated in a counter-clockwise direction along its longitudinal axis, the base 154 will tend to turn leftwardly as it is being pushed in a forward direction.

Park Lock

Figure 18:
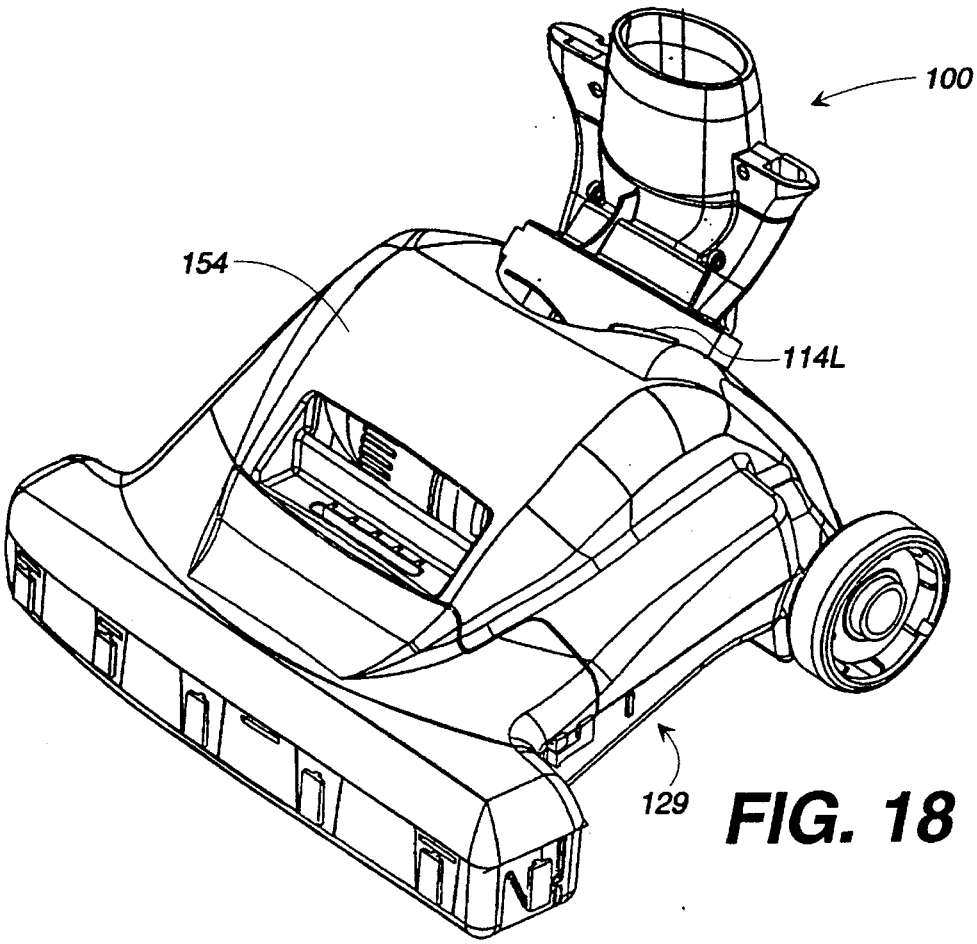
FIG. 18 is a perspective view of a base according to the present invention, with the base having various cosmetic elements removed, and the universal joint illustrated.

As may be understood, it is desirable to "park" a vacuum cleaner when it is not being used. In the present invention, such parking is done by urging the body of the vacuum cleaner forwardly from its operational position to its "park" position, such that the longitudinal axis of the body is tilted slightly forward from vertical, in the present invention approximately 5 degrees. Referring to FIG. 18, the upper universal joint member is illustrated such that the longitudinal axis is substantially vertical. The arrow illustrates the pivoting movement which the upper universal joint member is capable of, with the tilting from vertical being approximately 5 degrees, although other configurations are contemplated without departing from the spirit and scope of the present invention.

Figure 24:
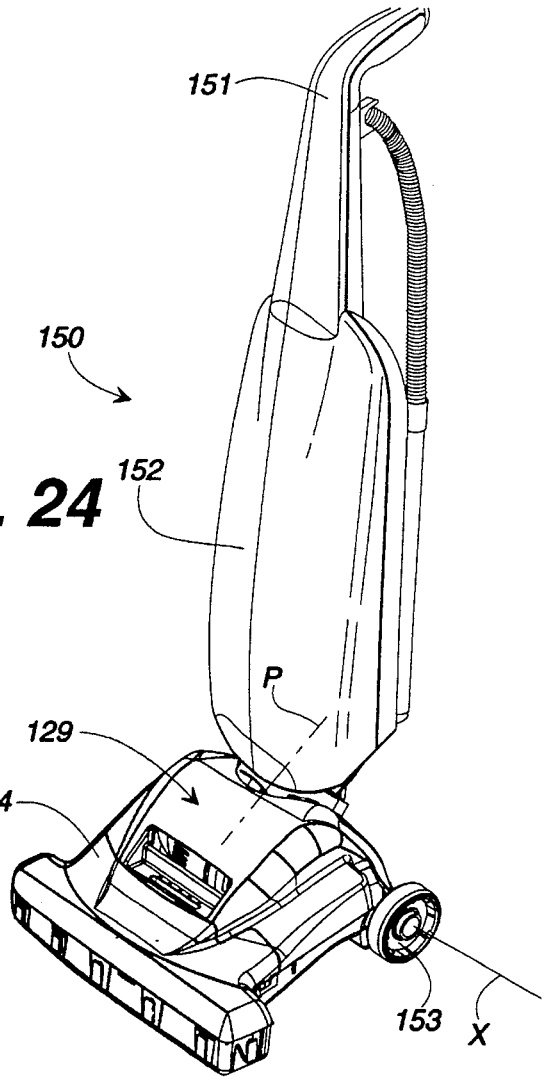
FIG. 24 is an illustrative view of a vacuum unit using the universal joint shown in FIG. 12.
Figure 25:
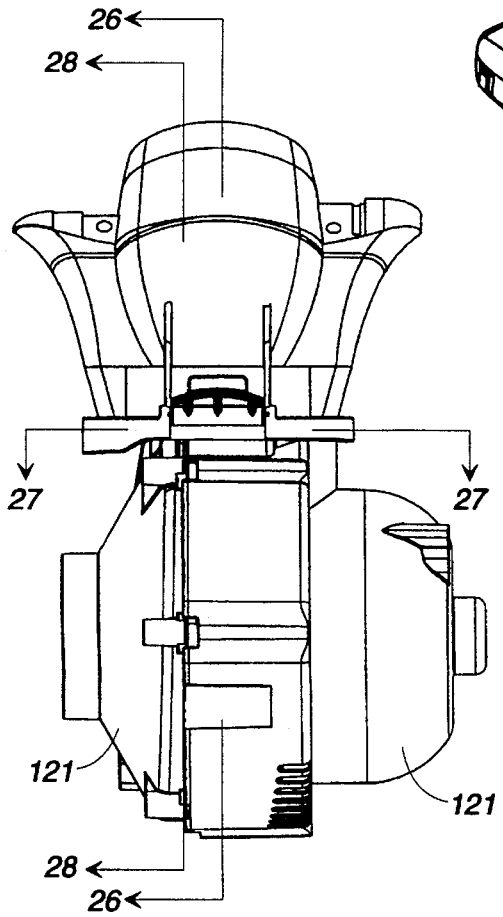
FIGS. 25–32 are other various views of the invention, particularly the steering lock feature.

Referring now to FIG. 24, it may be seen that the base element 154 includes a pair or rear wheels 153, and a cover portion 129. The three-piece motor housing pivots (being rigid with the upper joint member ) relative to the base along a horizontal axis "X" and pivots relative to the upper joint member along axis "P".

Figure 19:
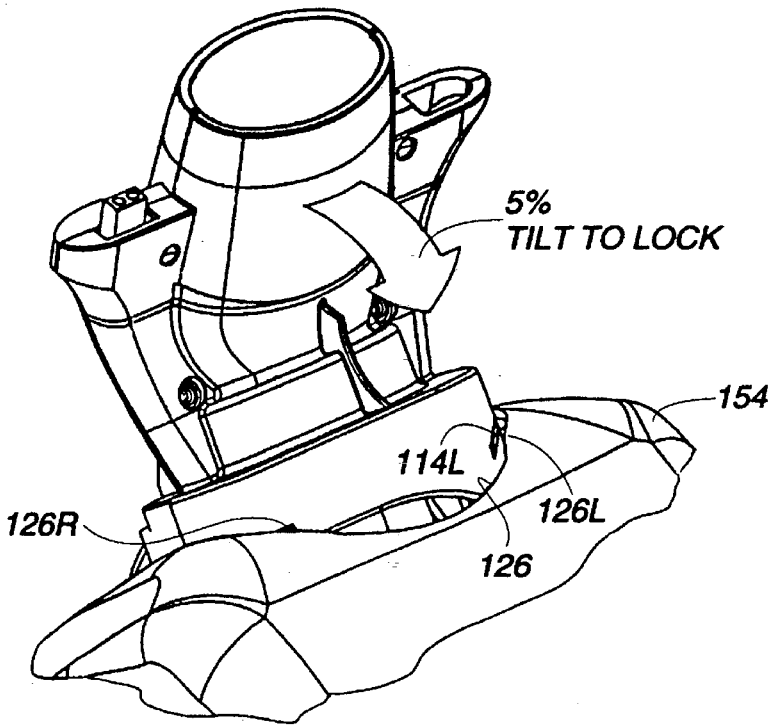
FIG. 19 is a more isolated view of a universal joint according to the present invention as shown in FIG. 17.
Figure 20:
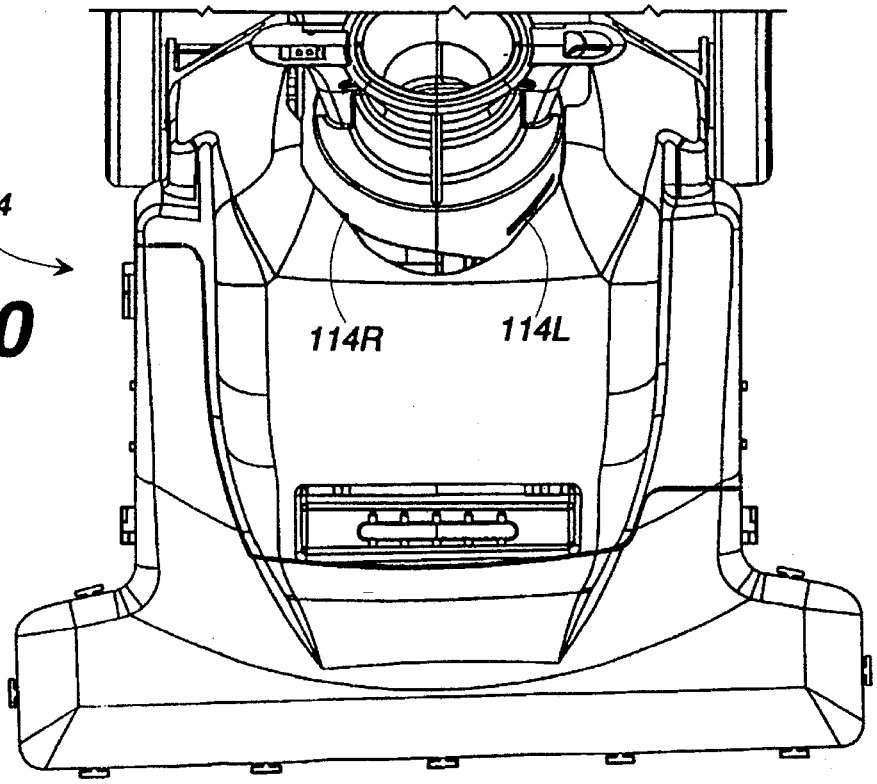
FIG. 20 is a top plan view of that illustrated in FIG. 18.
Figure 21:
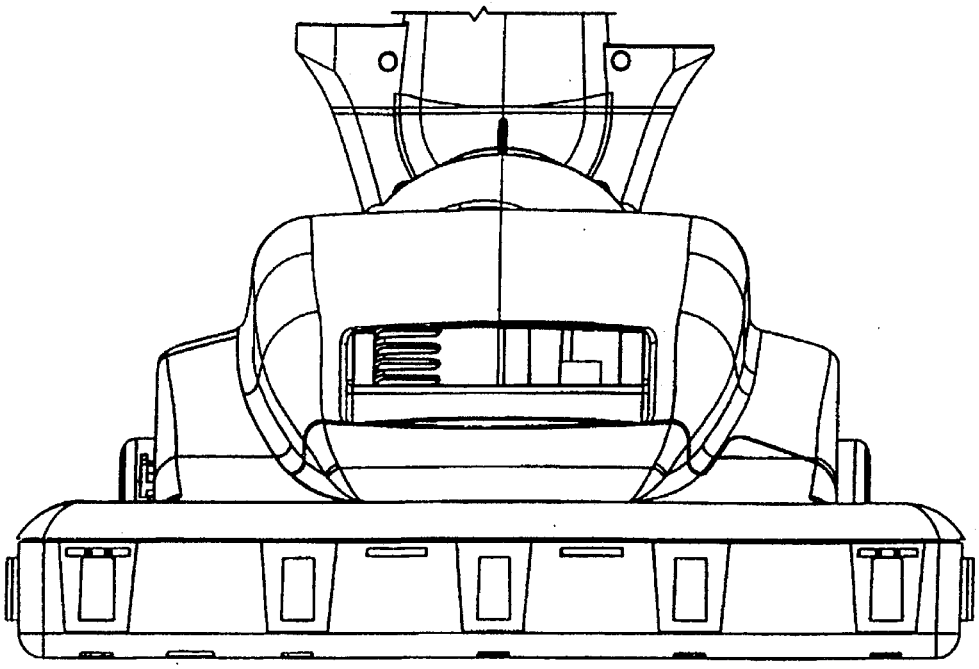
FIG. 21 is a front plan view of that illustrated in FIG. 18.
Figure 22:
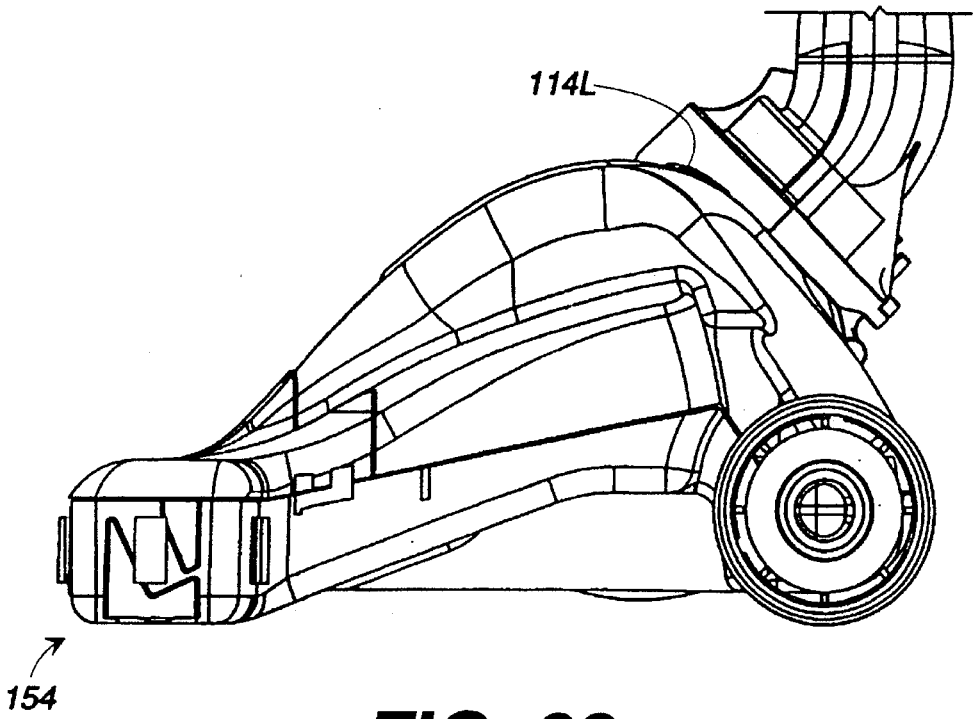
FIG. 22 is a side plan view of that illustrated in FIG. 18.

Referring now to FIG. 19, the cover portion defines an exposed edge 126 which includes a pair of edge portions 126L and 126R. When the unit is placed in its park" position, a positive (while in park) locking feature is provided by the interaction of a pair of slots 114R, 114L, defined by a portion of the upper universal joint member 104, with the pair of edge portions 126L and 126R, defined by the base 154 of the unit 150. When the unit is in its "park" configuration, the engagements of the edges within the slots prevents the upper universal joint member from rotating relatively to the lower universal joint member (as well as the motor housing). Such locking is provided regardless of the engagement or non engagement of the operating lock feature discussed in other areas of this application.

As shown in FIG. 19, when the unit is tilted back from its "park" position to a upright position, the park lock feature is disengaged. The universal joint is then allowed to operate unless it is "locked out" by a steering lock feature discussed in detail below.

Steering Lock

It may be understood that operators of the unit 150 may wish to "lock out" the universal joint, in order to use the apparatus more in the manner of prior art apparatuses. Such a "lock out" feature is provided by the use of a steering lock 120, as shown in FIGS. 12, 13, 16, and 25–31.

Figure 26:
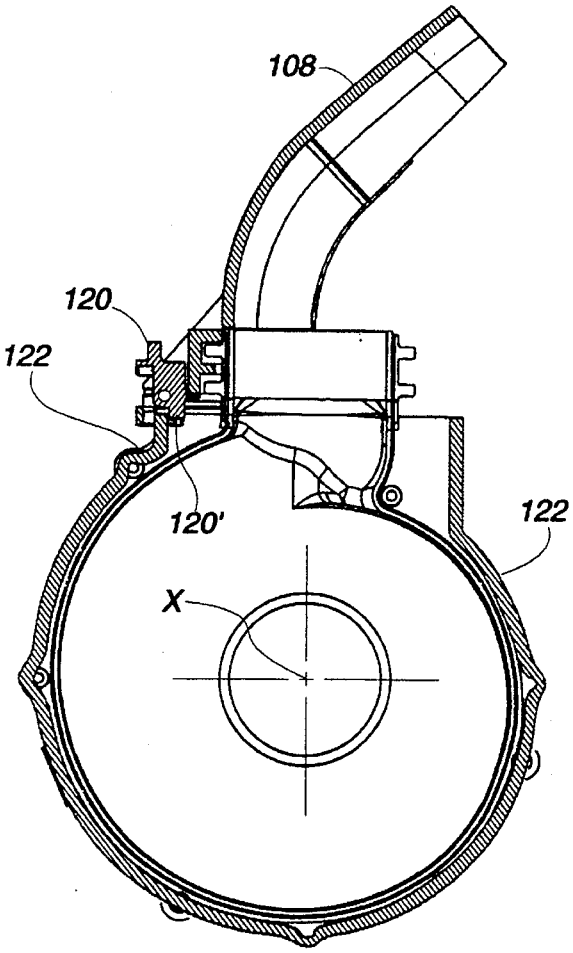
Figure 27:
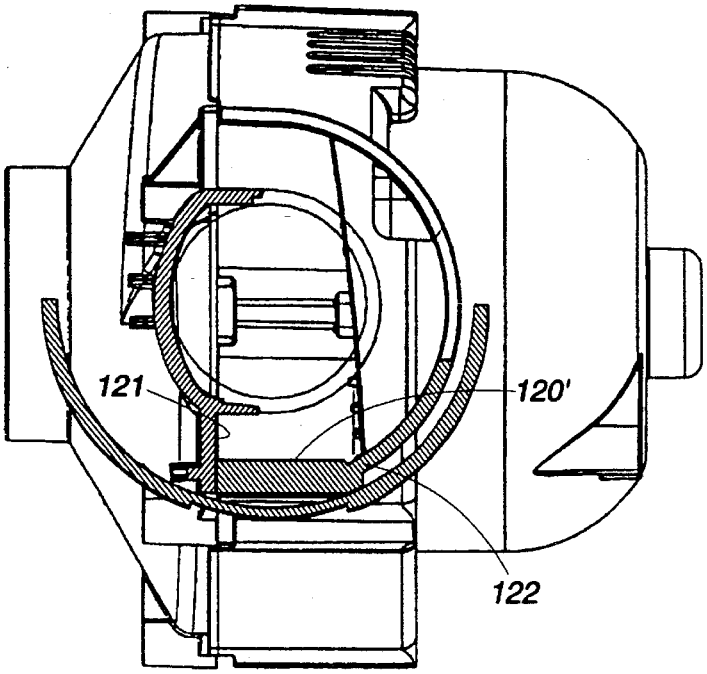
Figure 28:
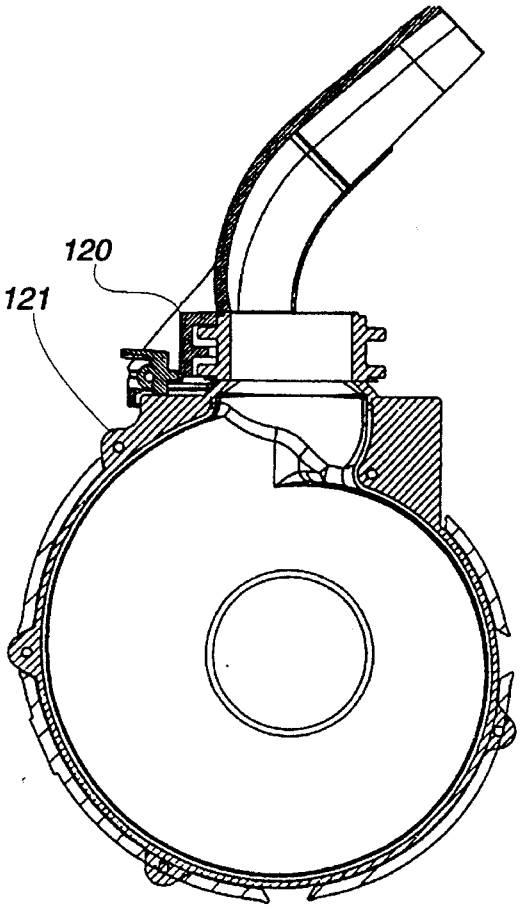
Figure 30:
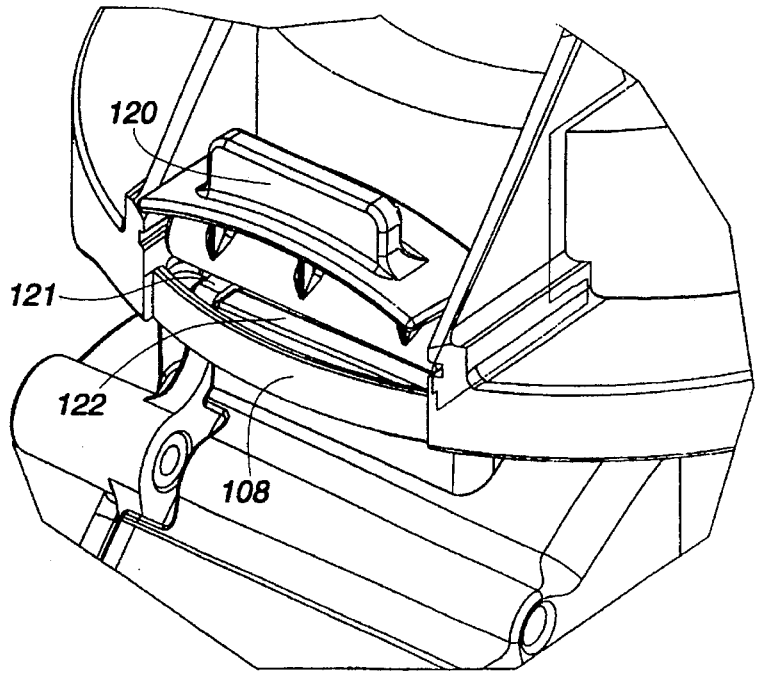
Figure 29:
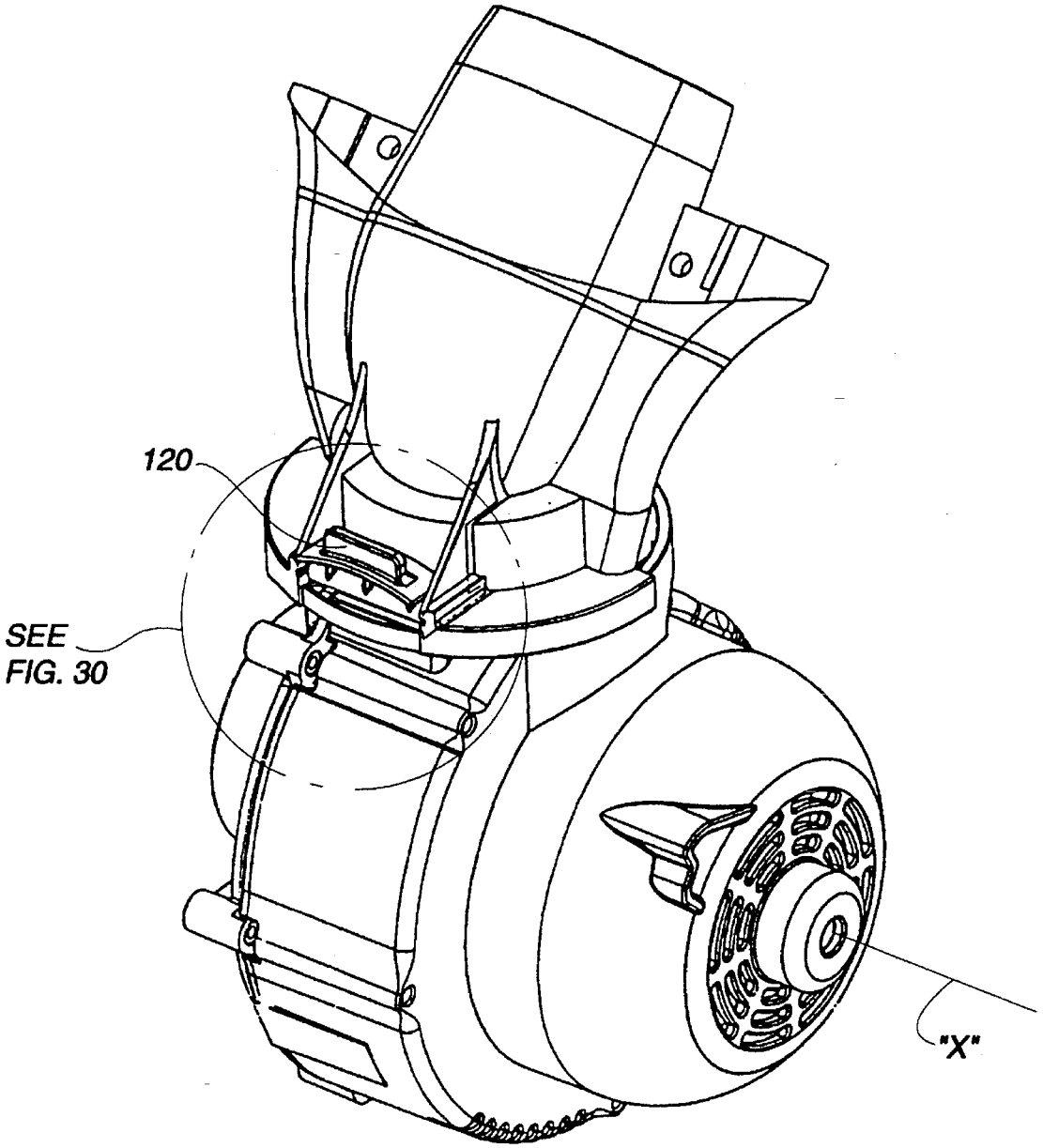
Figure 31:
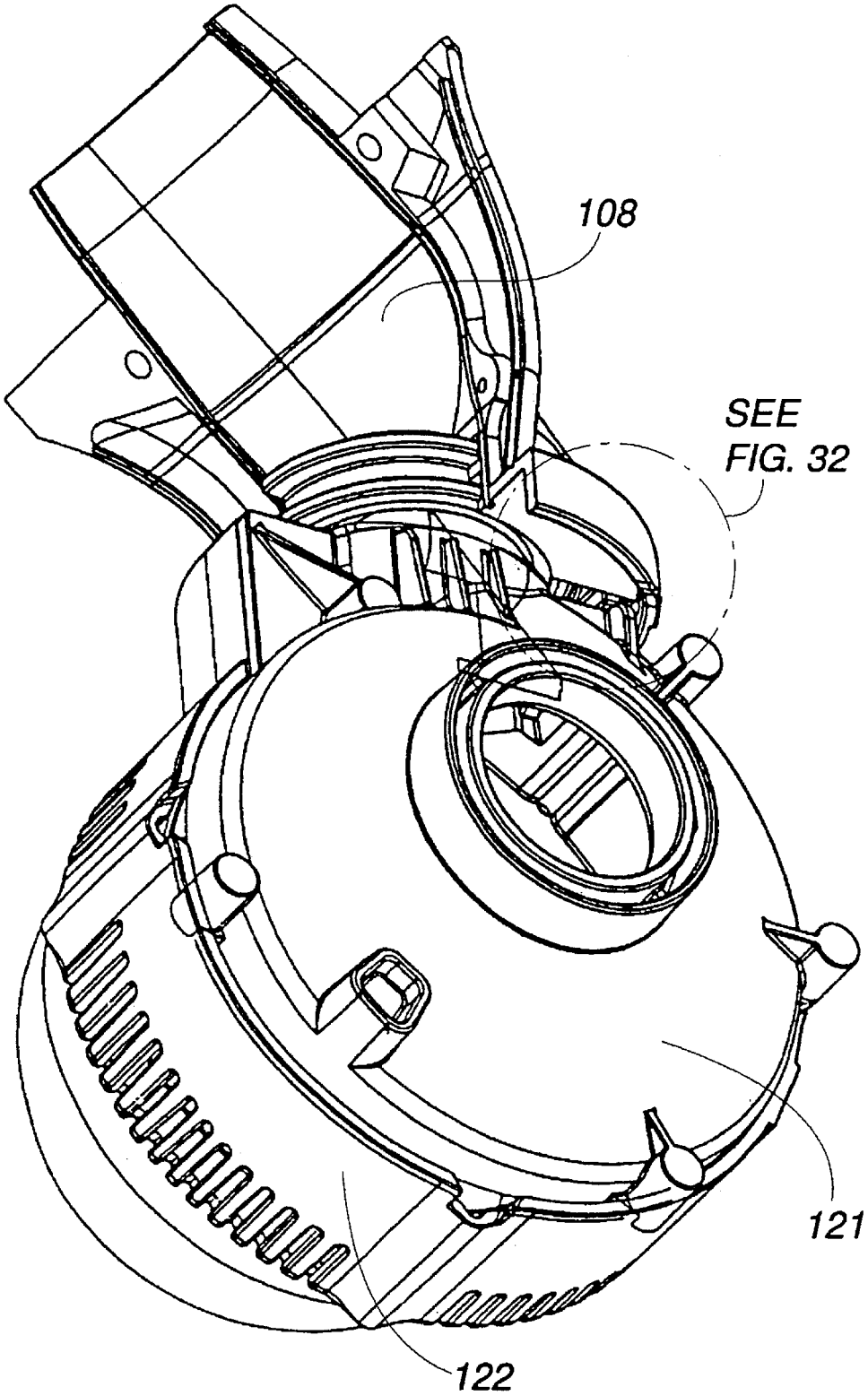
Figure 32:
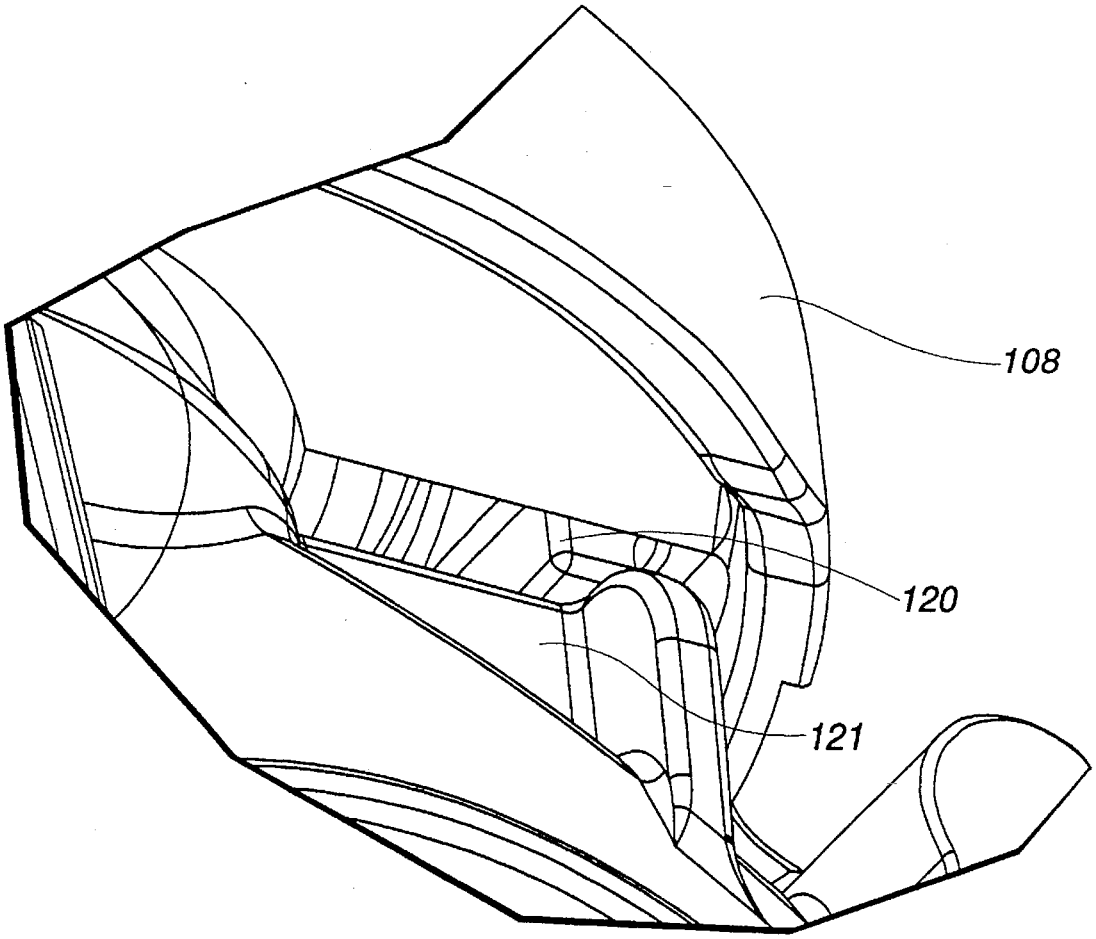

Steering lock member 120 is pivotably mounted relative to the rear member 108, such that the steering lock member 120 is allowed to pivot or rotate about a substantially horizontal axis during typical orientation (such as at rest) of the unit 150. A pair of opposing pivot pins, extend from the steering lock 120, and fit within corresponding holes defined by the rear member 108. As shown in FIGS. 26 and 27, a locking "tab" 120, having a rectangular transverse cross-section, fits within a corresponding slot defined by the motor cover 122 and fan shroud 121.

The locking member 120 may be used by the operator to "lock out" rotational movement between the upper universal joint 104 and the motor housing 102 even when the unit is not in its parked position but is operating. This is advantageous in that it will allow an operator to selectively "lock-out" rotation between the members 104, 102, such that the unit operators more like a conventional vacuum cleaner.

It may be understood that the operational lock feature is provided by urging the operational lock tabbed member forwardly, which may be done by a foot or hand. To disengage the operational lock feature, the member is pivoted rearwardly, or clockwise as viewing FIG. 16. To engage the operational lock feature, the member is pivoted forwardly, or counterclockwise as viewed in FIG. 16.

Wiring

Referring now to FIG. 13, it may be understood that electrical connections are necessary between the upper part of the unit (typically containing the on and off switches and the motor). This is to provide operation of the motor. A electrical connector 118 includes a pair of leads extending therefrom to the motor or necessary elements. The electrical connector fits as shown into the front part of the universal joint member, and is held in place when the front and rear elements 110, 108, are joined together. The leads extend downwardly into a "slack" cavity 133 (se FIG. 16) defined at least in part by the motor cover 122.

As may be understood, to allow the upper universal joint member to rotate relative to the lower universal joint member and the motor housing, a certain amount of "slack" must be present in the electrical leads. This slack is taken up due to the existence of the slack cavity 127.

Figure 23:
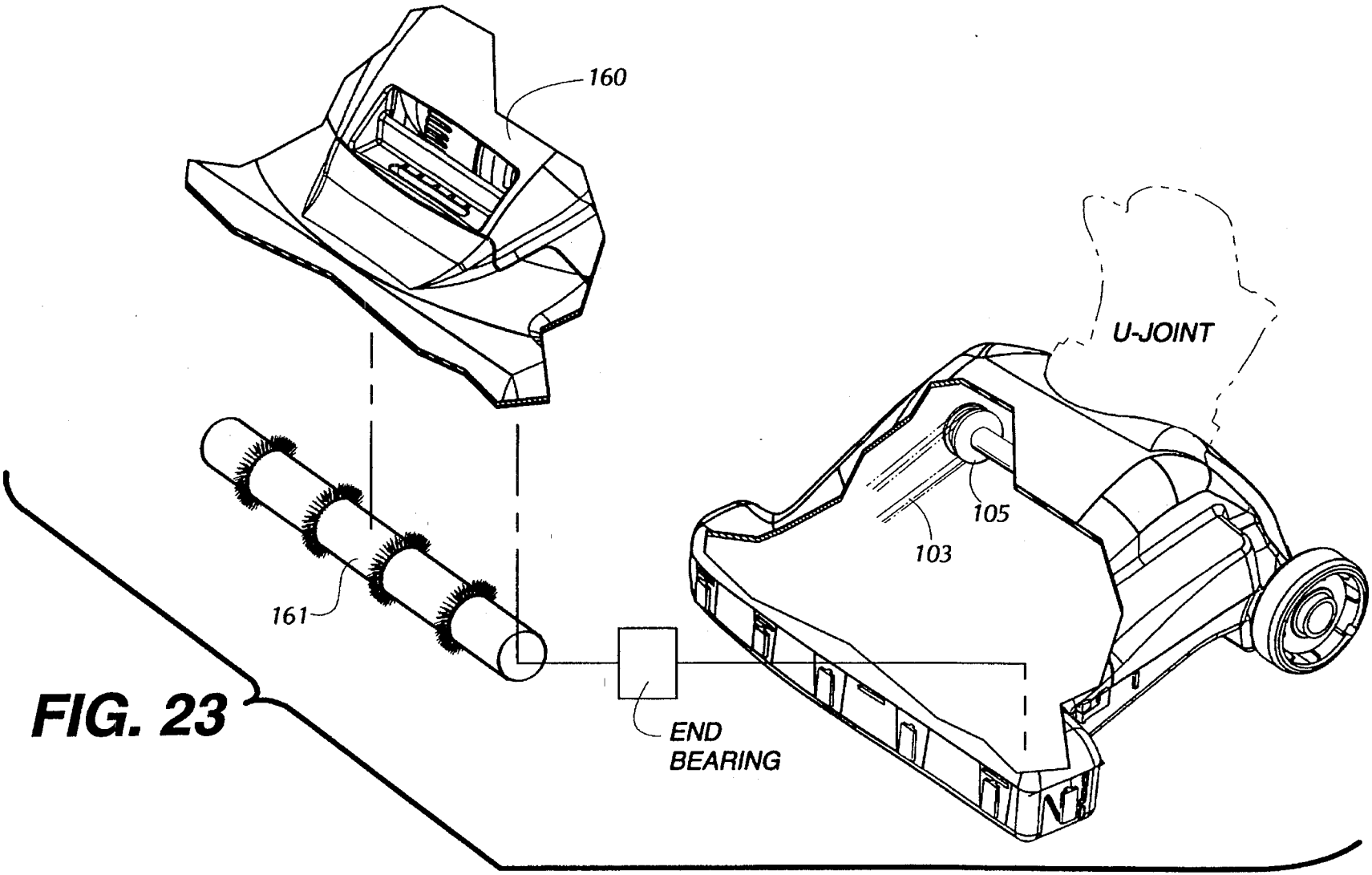
FIG. 23 is an illustrative view of a base according to the present invention, with a top cover and brushroll illustrated in exploded view.

Referring now to FIG. 23, a removable top cover according to the present invention is now illustrated. As may be seen, a top cover portion 160 is removable to allow upward removal of a brushroll 161 and or to allow access to a drive belt path 103 or a drive pulley 105 driven by the motor within the motor housing. The base is shown as 129.

While this invention has been described in specific detail with reference to the disclosed embodiments, it will be understood that many variations and modifications may be effected within the spirit and scope of the invention as described in the appended claims.

What is claimed is:

1. A vacuum cleaner, comprising:

a base;

a motor housing pivotally attached to said base about a substantially horizontal first axis;

a substantially upright elongate body portion including a handle portion; and a universal joint assembly defining an air channel capable of facilitating the flow of air from said base to said body portion, said joint assembly itself comprising;

a) an upper universal joint portion rigidly attached to said body portion; and b) a lower universal joint portion rigidly affixed to said motor housing, one of said upper and lower portions being a male member and the other being a female and said upper and lower universal joint portions being linked such that said upright body portion may be rotated along a second axis relative to said motor housing, such that twisting said upright body portion clockwise along said longitudinal axis while pushing said vacuum cleaner forward tends to cause said vacuum cleaner base to turn right, and twisting said upright body portion counterclockwise along said longitudinal axis while pushing said vacuum cleaner forward tends to cause said vacuum cleaner base to turn left.

2. The vacuum cleaner as claimed in claim 1, wherein said female member is a two-piece configuration to allow said female member to capture said male member during assembly but to still allow said pivoting.

3. The vacuum cleaner of claim 2, wherein said linking is provided by at least one annular locking rib extending inwardly from said upper universal joint member, and interlocking with at least one annular locking rib extending outwardly from said lower universal joint member.

4. The vacuum cleaner of claim 1, wherein said lower universal joint portion rigidly extends from said motor housing and said upper universal joint member extends rigidly from said body.

5. the vacuum cleaner as claimed in claim 4, wherein said first pivoting axis between said motor housing and said base is substantially orthogonal to said second pivoting axis between said motor housing and said body or said vacuum cleaner.

6. The vacuum cleaner as claimed in claim 5, wherein said motor housing may be selectively locked and unlocked relative to said base such that said pivoting relationship between said motor housing and said base may be correspondingly disallowed and allowed.

7. A vacuum cleaner, comprising:

a base;

a motor housing pivotally attached to said base about a substantially horizontal first axis;

a substantially upright elongate body portion including a handle portion;

a universal joint assembly defining an air channel capable of facilitating the flow of air from said base to said body portion, said joint assembly itself comprising;

a) an upper universal joint portion rigidly attached to said body portion; and b) a lower universal joint portion rigidly affixed to said motor housing, one of said upper and lower portion being a male member and the other being a female and said upper and lower universal joint portions being linked such that said upright body portion may be rotated along a second axis relative to said motor housing, such that twisting said upright body portion clockwise along said longitudinal axis while pushing said vacuum cleaner forward tends to cause said vacuum cleaner base to turn right, and twisting said upright body portion counterclockwise along said longitudinal axis while pushing said vacuum cleaner forward tends to cause said vacuum cleaner base to turn left, and a park lock to facilitate locking of said universal joint responsive to placing said vacuum cleaner in a parked position.

8. The vacuum cleaner as claimed in claim 7, wherein said park lock is provided by interference between said base and said upper universal joint portion when said vacuum cleaner is in said parked position.

9. The vacuum cleaner as claimed in claim 8, wherein said base of said vacuum further includes a wall and said upper universal joint portion defines a slot, and said park lock is provided by interference between said wall and said slot when said vacuum cleaner is in said parked position.

10. A vacuum cleaner, comprising:

a base;

a motor housing pivotally attached to said base about a substantially horizontal first axis;

a substantially upright elongate body portion including a handle portion;

a universal joint assembly defining an air channel capable of facilitating the flow of air from said base to said body portion, said joint assembly itself comprising;

a) an upper universal joint portion rigidly attached to said body portion; and b) a lower universal joint portion rigidly affixed to said motor housing, one of said upper and lower portion being a male member and the other being a female and said upper and lower universal joint portions being linked such that said upright body portion may be rotated along a second axis relative to said motor housing, such that twisting said upright body portion clockwise along said longitudinal axis while pushing said vacuum cleaner forward tends to cause said vacuum cleaner base to turn right, and twisting said upright body portion counterclockwise along said longitudinal axis while pushing said vacuum cleaner forward tends to cause said vacuum cleaner base to turn left, and a steering lock to facilitate selective locking of said upper universal joint portion relative to said motor housing.

11. The vacuum cleaner as claimed in claim 10, wherein said steering lock is provided by a selectively lockable tab pivotably attached relative to said upper universal joint portion which pivots from an unlocked position to a locked position by manual operation of an operator.

12. A vacuum cleaner, comprising:

a base;

a motor housing pivotally attached to said base about a substantially horizontal first axis;

a substantially upright elongate body portion including a handle portion;

a universal joint assembly defining an air channel capable of facilitating the flow of air from said base to said body portion, said joint assembly itself comprising;

a) an upper universal joint portion rigidly attached to said body portion; and b) a lower universal joint portion rigidly affixed to said motor housing, one of said upper and lower portion being a male member and the other being a female and said upper and lower universal joint portions being linked such that said upright body portion may be rotated along a second axis relative to said motor housing, such that twisting said upright body portion clockwise along said longitudinal axis while pushing said vacuum cleaner forward tends to cause said vacuum cleaner base to turn right, and twisting said upright body portion counterclockwise along said longitudinal axis while pushing said vacuum cleaner forward tends to cause said vacuum cleaner base to turn left, a park lock to facilitate locking of said universal joint responsive to placing said vacuum cleaner in a parked position; and a steering lock independent of said park lock to facilitate selective locking of said upper universal joint portion relative to said motor housing.

13. A vacuum cleaner, comprising:

a base;

a motor housing pivotally attached to said base about a substantially horizontal first axis;

a substantially upright elongate body portion including a handle portion;

a universal joint assembly defining an air channel capable of facilitating the flow of air from said base to said body portion, said joint assembly itself comprising;

a) an upper universal joint portion rigidly attached to said body portion; and b) a lower universal joint portion rigidly affixed to said motor housing, one of said upper and lower portion being a male member and the other being a female and said upper and lower universal joint portions being linked such that said upright body portion may be rotated along a second axis relative to said motor housing, such that twisting said upright body portion clockwise along said longitudinal axis while pushing said vacuum cleaner forward tends to cause said vacuum cleaner base to turn right, and twisting said upright body portion counterclockwise along said longitudinal axis while pushing said vacuum cleaner forward tends to cause said vacuum cleaner base to turn left, electrical wire passing through said upper and lower universal joint portions; and a wire storage cavity at least partially defined by said lower universal joint element to facilitate the containment of slack in said wire during pivoting of said upper universal joint portions.

* * * * *